US010641577B1

(12) United States Patent
Archer

(10) Patent No.: US 10,641,577 B1
(45) Date of Patent: May 5, 2020

(54) COMPOUND ARCHERY BOW WITH LATCH THAT MAINTAINS FULL DRAW WITH ZERO STRING DRAW WEIGHT

(71) Applicant: Gene R. Archer, Newark, OH (US)

(72) Inventor: Gene R. Archer, Newark, OH (US)

( * ) Notice: Subject to any disclaimer, the term of this patent is extended or adjusted under 35 U.S.C. 154(b) by 0 days.

(21) Appl. No.: 16/526,319

(22) Filed: Jul. 30, 2019

(51) Int. Cl.
*F41B 5/10* (2006.01)
*F41B 5/14* (2006.01)

(52) U.S. Cl.
CPC ..... *F41B 5/105* (2013.01); *F41B 5/1469* (2013.01)

(58) Field of Classification Search
CPC ..... F41B 5/10; F41B 5/105; F41B 5/1403; F41B 5/1469
USPC ..... 124/25.6, 86, 87, 90, 900
See application file for complete search history.

(56) References Cited

U.S. PATENT DOCUMENTS 3,756,214 A * 9/1973 Christen ..... F41B 5/1407 124/23.1
4,020,819 A * 5/1977 Haines ..... F41B 5/10 124/25.6
4,294,221 A * 10/1981 Bryant ..... F41B 5/105 124/25.6
4,458,657 A * 7/1984 Stockmar ..... F41B 5/0094 124/17
4,465,054 A * 8/1984 Nishioka ..... F41B 5/10 124/25.6
4,471,747 A * 9/1984 Nishioka ..... F41B 5/10 124/23.1
4,757,799 A * 7/1988 Bozek ..... F41B 5/10 124/25.6
4,886,039 A * 12/1989 Wagner ..... F41B 5/10 124/25.6
5,092,309 A * 3/1992 Beaton ..... F41B 5/10 124/25.6
5,156,138 A * 10/1992 Grover ..... F41B 5/0026 124/24.1
5,950,609 A * 9/1999 Thielen ..... F41B 5/105 124/25.6
5,967,131 A * 10/1999 Hervig ..... F41B 5/1403 124/25.6
6,032,660 A * 3/2000 Hervig ..... F41B 5/10 124/25.6
6,679,242 B1 * 1/2004 Martin ..... F41B 5/1426 124/90
8,266,933 B2 * 9/2012 Bishir, Jr. ..... E05B 67/24 124/86

(Continued)

*Primary Examiner* — Alexander R Niconovich
(74) *Attorney, Agent, or Firm* — Frank H. Foster; Kremblas & Foster

(57) ABSTRACT

An accessory attached to a compound archery bow permitting an archer to pull the bowstring to full draw, actuate a latch and then relax both arms but leave the bow at full draw. At least two cam latches are mounted at the distally opposite end of each of the bow's limbs. Each cam latch is movable into engagement with its associated cam to latch and prevent rotation of the cams. A movable latch trigger is mounted to the riser adjacent the hand grip for actuating the cam latches. A mechanical linkage is connected between the latch trigger and each of the cam latches. The mechanical linkage is moved by the latch trigger to move the cam latches into engagement with the cams and prevent rotation of the cams and is also movable for release of the cam latches into disengagement with the cams to permit rotation of the cams.

9 Claims, 7 Drawing Sheets

(56) References Cited

U.S. PATENT DOCUMENTS

| | | | | |
|---|---|---|---|---|
| 8,347,664 | B2 * | 1/2013 | Bishir, Jr. | E05B 37/025 124/86 |
| 8,656,900 | B1 * | 2/2014 | Kronengold | F41B 5/10 124/90 |
| 8,893,694 | B1 * | 11/2014 | DeBole | F41B 5/0094 124/25.6 |
| 9,518,798 | B1 * | 12/2016 | Farren | F41B 5/10 |
| 10,473,417 | B1 * | 11/2019 | Peacemaker | F41B 5/105 |
| 2013/0061839 | A1 * | 3/2013 | Asherman | F41B 5/10 124/25.6 |
| 2017/0131057 | A1 * | 5/2017 | Farren | F41B 5/1403 |

* cited by examiner

FIG. 2
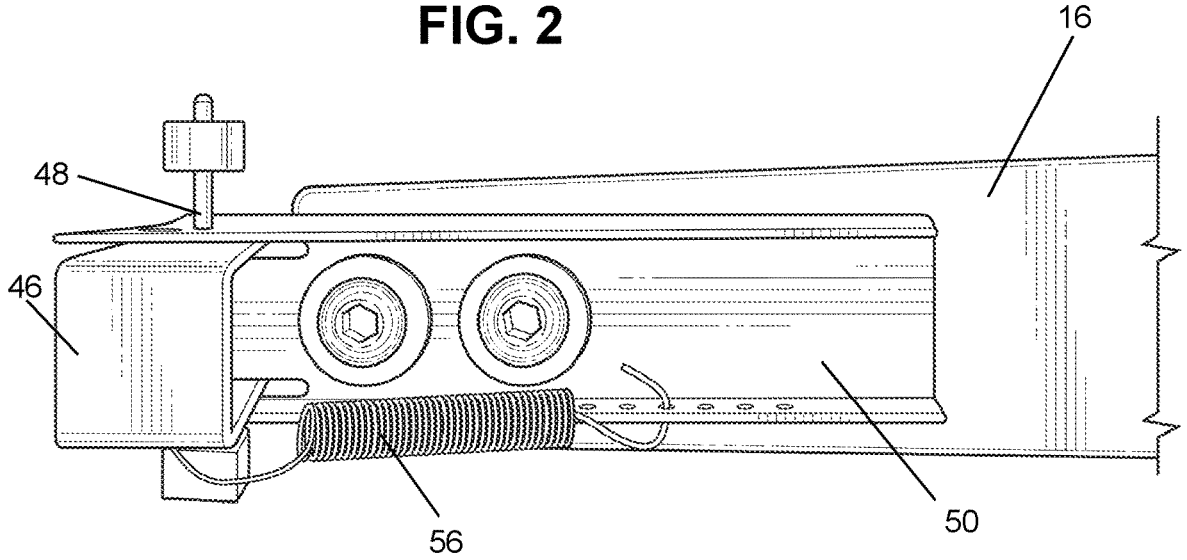
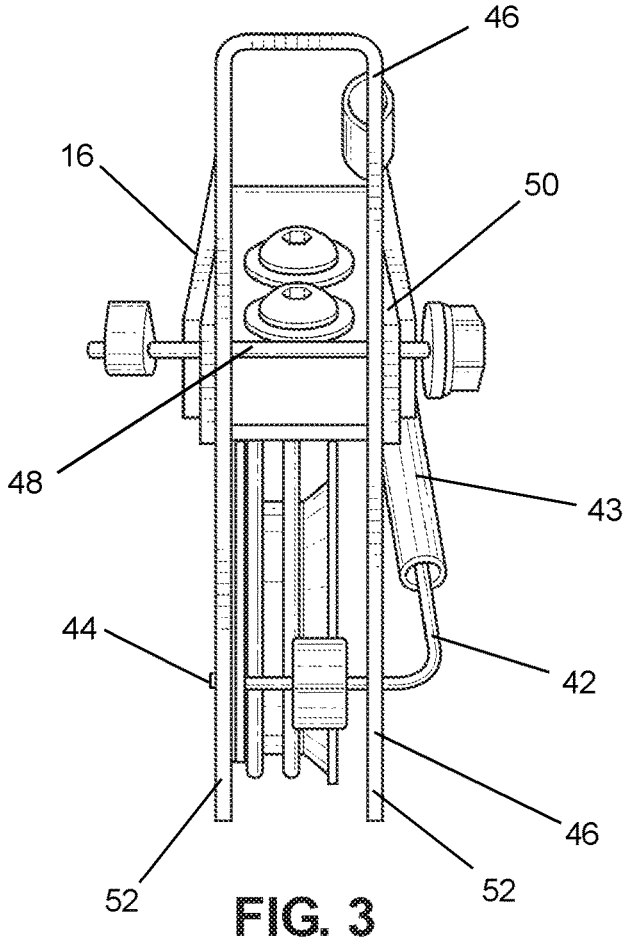
FIG. 3

COMPOUND ARCHERY BOW WITH LATCH THAT MAINTAINS FULL DRAW WITH ZERO STRING DRAW WEIGHT

BACKGROUND OF THE INVENTION

This invention relates to archery and more particularly relates to a bow accessory that is attached to a compound bow and allows an archer to reduce the drawstring holding weight to zero while the bow remains at full draw of the drawstring.

Archery is a historically traditional as well as a modern sport that is enjoyed for both competition and for hunting. Over the last half century, the compound bow has become a popular option for archers because of its advantageous characteristics. The principles of the operation of a compound bow are described in or evident from U.S. Pat. No. 3,486,495 which is incorporated by reference into this application. This patent is believed to be the original U.S. patent on the compound bow. Since then there have been many other patents for features of compound bows.

As with all bows, the limbs of the bow are cantilever springs that are fixed at their inner ends to a central frame called a riser and attached at their outer ends to a bowstring. The limbs store potential energy as they are bent back, within their elastic limit, by the force of an archer's arm drawing back on the bowstring. The most important characteristic of the compound bow is that the energy stored in its limbs, at a selected or standard draw length, is greater than the energy stored in a conventional bow and the force required to hold the bowstring at full draw is not only less than the maximum force that is required to draw the bowstring to full draw but also is considerably less than the draw force required for a conventional bow (which is maximum at full draw). The force that is applied by an archer to a drawstring in order to pull the drawstring back away from the riser of the bow is commonly called the draw weight.

As the bowstring of a compound bow is drawn back, the draw force initially increases but, as the bowstring approaches full draw, the draw force is reduced. That makes it somewhat easier for an archer to hold the bowstring at full draw because the archer is exerting a considerably smaller force on the bowstring than the maximum draw force of the compound bow and at an even smaller draw force than a conventional bow. The "let off" is the draw force reduction for a compound bow and can be as much as 70% to 80%. Additionally, at full draw the energy stored in the limbs is considerably greater than the energy stored in a conventional bow even though the draw force at full draw is considerably less. The ultimate result is that some archers are able to hold the bowstring at full draw with less draw force while simultaneously having more potential energy stored in the limbs for powering the arrow along its trajectory.

When an archer is bow hunting, it is common for the archer to hear game which is unseen or to see game in a location at which the archer does not want to take a shot because it is likely that the arrow will not hit the target game or is likely to hit the game in an undesirable manner. For example, the game may be too far away and beyond the range of an arrow or the game may be partially hidden behind an obstruction, such as a tree or brush. However, when the archer is in that situation, it is desirable to maintain the arrow positioned in the bow and hold the bowstring drawn to full draw until a shot at the game becomes practical. One reason to maintain full draw is to be ready to immediately take a shot at the game as soon as a sufficient opportunity arises. A hunter with a bow does not want to wait to draw back the bowstring until after the game is observed in a position where a shot can be responsibly taken. The reason is that drawing the drawstring generates noise and causes motion both of which can attract the attention of the game and cause it to run away. So a hunter would like to draw the bowstring to full draw as soon as he or she sees or catches a glimpse of the game or otherwise suspects the game to be nearby. After drawing the bowstring to full draw, the hunter would like to hold the drawstring at full draw while waiting for a good shot opportunity. So a second reason for maintaining the bow in the ready, full drawn position is to avoid making the noise or motion of drawing the bow to full draw when the game approaches because that generates a noise or motion that can scare the game away.

Unfortunately, it often takes a substantial period of time for the game to appear in a location where a shot can be responsibly taken. Holding the bow at full draw for a substantial length of time is not a problem for some people, especially people who are younger, stronger and in good physical condition. However, for some hunters it is difficult and/or uncomfortable to hold the bow at full draw for the necessary time interval. Holding a bowstring at full draw can cause discomfort or even pain for the archer while the bowstring is being held fully drawn for an indefinite period of time. For some people it is difficult to even pull the drawstring to full draw and impossible to maintain it in that position for any length of time. Doing so is simply beyond some archer's practical strength and/or endurance. Nonetheless such an archer still has the ability and the desire to continue hunting.

Consequently, there is a need for a bow accessory that would allow an archer to pull a bowstring to full draw and have the bowstring be retained at full draw without requiring the archer to continuously apply an aft-directed draw force on the bowstring in order to maintain the full draw.

It is therefore an object and purpose of the present invention to provide a latching mechanism that allows the archer to pull the bowstring to full draw, actuate the latching mechanism to retain the full draw state of the bow without requiring a force to be applied to the bowstring and then, when the archer is ready to shoot, pull slightly on the bowstring and operate the latching mechanism to release the bow back to its state for normal operation.

BRIEF SUMMARY OF THE INVENTION

The invention is an accessory that is attached to a compound archery bow and permits an archer to pull the bowstring to full draw, actuate a latch and then relax both arms but leave the bow in a state of full draw. The invention has at least two cam latches that are mounted at the distally opposite end of each of the bow's limbs. Each cam latch is movable into engagement with its associated cam to latch and prevent rotation of the cams. A movable latch trigger is mounted to the riser adjacent the hand grip for actuating the cam latches. A mechanical linkage is connected between the latch trigger and each of the cam latches. The mechanical linkage is moved by the latch trigger to move the cam latches into engagement with the cams and prevent rotation of the cams and is also movable for release of the cam latches into disengagement with the cams and permit rotation of the cams.

BRIEF DESCRIPTION OF THE SEVERAL VIEWS OF THE DRAWINGS

FIG. 2 is a top view in perspective of the cam latch of the invention.

FIG. 3 is an end view in perspective of the cam latch of FIG. 2.

Figure 1:
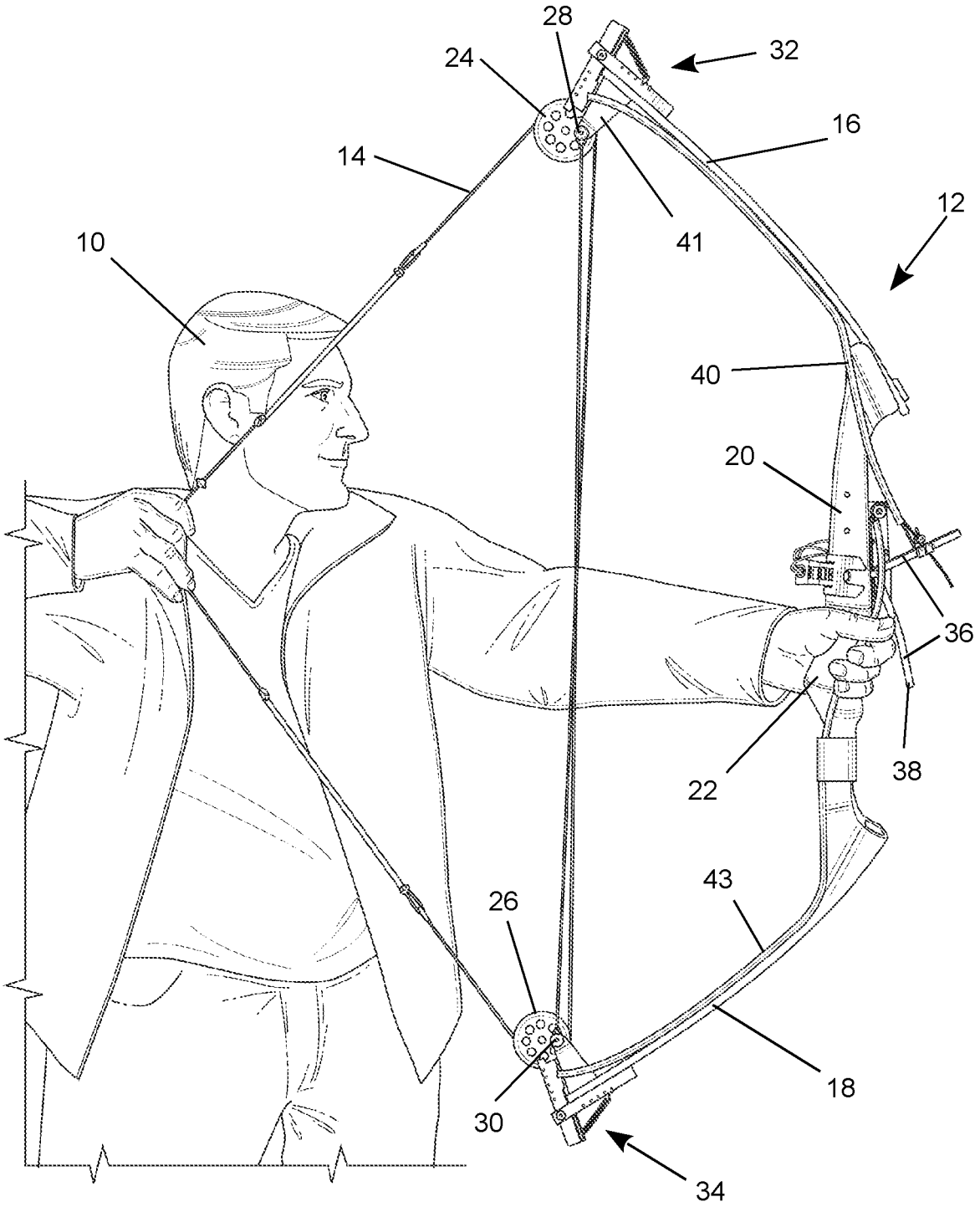
FIG. 1 is a view in vertical elevation of an archer holding a compound bow that is equipped with an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

In this description of the invention, the terms forward and aft, upper and lower, above and below, and central and outer are used with reference to the normal position of the bow when held by an archer in the operating, shooting position. Forward refers to the direction from the archer toward the target, aft refers to the direction from the target back toward the archer. Upper refers to the part of the bow that is above the hand grip of the riser and lower refers to a part that is below the hand grip. Above means at a greater height and below means at a lower height. Central means toward the center of the riser and outer means outward from the center of the riser toward or beyond the distal ends of the limbs.

FIG. 1 illustrates an archer 10 holding a compound bow 12 with the bowstring 14 pulled back to its full draw position. The bow 12 has a pair of limbs 16 and 18 connected to and extending outwardly in opposite directions from opposite ends of an interposed riser 20. The riser 20 has a central hand grip 22. Mounted to each of the distally opposite ends of the limbs 16 and 18 are a different one of two rotatable cams including an upper cam 24 and a lower cam 26. The cams 24 and 26 are rotatably mounted respectively to eccentric cam axles 28 and 30 that are fixed to distally opposite ends of the limbs 16 and 18. The cams 24 and 26 peripherally engage the bowstring in the conventional manner that is well known in the prior art.

An overview of an embodiment of the invention is also illustrated in FIG. 1. The component parts of the embodiment form an accessory that is attached to any conventional compound bow 12. For terminology simplification, the illustrated embodiment is referred to as the invention although many other embodiments of the invention will become obvious from the description of the illustrated embodiment.

The invention has three principal component parts and preferably has a fourth component that is highly desirable. These component parts can be summarized as:

(1) a latch trigger 36 that is mounted at the hand grip 22 in a position where it can be actuated by one or more fingers of an archer when the archer's hand is held against the hand grip 22 in a position that is normal in the sport of archery;

(2) a pair of cam latches 32 and 34, one positioned at each of the cams 24 and 26 and capable of being actuated to engage the cams in a manner that prevents the cams from rotating;

(3) a mechanical linkage 40 connected between the latch trigger 36 and each cam latch 32 and 34 so that the archer can operate the latch trigger 36 alternatively to cause the cam latches 32 and 34 to engage and prevent rotation of the cams 24 and 26 or to disengage the cam latches 32 and 34 and permit rotation of the cams 24 and 26; and (4) a slack tightener that preferably is an elastically resilient band attached to the aft-most segment of the drawstring that extends between the cams so that the elastically resilient band takes up the slack in the bowstring that occurs when the bowstring is drawn and the cam latches 32 and 34 engage and prevent rotation of the cams 24 and 26.

The cam latches 32 and 34 are mounted at a distally opposite end of each of the limbs 16 and 18 where the cams 24 and 26 are located. As will be seen in a more detailed description of the component parts, each cam latch 32 and 34 is movable into engagement with an associated one of the cams 24 and 26 to latch and prevent rotation of the cams 24 and 26. The phrase "movable into engagement" means either (1) that a part of the cam latch makes contact with a part of or on the cam and the contact prevents further rotation of the cam or (2) that a part of the cam latch moves into a position where release of the bowstring brings a part of the cam and a part of the latch into contact and that contact prevents further rotation of the cam.

The movable latch trigger 36 is mounted to the riser 20 adjacent the hand grip 22. The preferred latch trigger 36 has a trigger handle 38 pivotally mounted to the riser 20 and extending forward of the hand grip 22. The trigger handle 38 and the mechanical linkage 40 are configured to move the two cam latches 32 and 34 into engagement with their associated cams 24 and 26 by pivoting movement of the trigger handle 38 toward the hand grip 22.

The mechanical linkage 40 is connected between the latch trigger 36 and each of the cam latches 32 and 34. The mechanical linkage 40 is movable by movement of the latch trigger 36 to move the cam latches 32 and 34 into engagement with the cams 24 and 26 in a manner that prevents rotation of the cams 24 and 26. The mechanical linkage 40 may also move with movement of the latch trigger 36 to release the cam latches 32 and 34 into disengagement with the cams 24 and 26 to permit rotation of the cams 24 and 26 in the manner of the normal operation of the compound bow 12.

Mechanical Linkage.

Turning now to details of the structural components of the invention, the mechanical linkage can be any one of the many mechanical linkages that are well known to those skilled in the mechanical arts. The mechanical linkage transfers a force and motion from a first device at one location, such as the latch trigger 36, to one or more second devices at other locations, such as the cam latches 32 and 34.

The preferred mechanical linkage is a flexible wire 42 (visible in FIGS. 3-5, and 9-11) that is connected to the latch trigger 36 and extends from the latch trigger 36 to each of the cam latches 32 and 34. The flexible wire type of mechanical linkage is constructed in a manner known in the prior art and its flexible wire 42 may extend partially around one or more pulley sheaves (wheels with a peripheral grooved rim). The flexible wire 42 applies a tensile force on the cam latches 32 and 34 when the trigger handle 38 of the latch trigger 36 is pulled by the archer toward the hand grip 22. That tensile force moves the cam latches 32 and 34 into a position that prevents rotation of the cams 24 and 26. Preferably the flexible wire 42 is surrounded by a tubular sheath 43 in the form of a plastic tube. The sheath 43 protects the wire 42 against direct contact with or catching on other objects and from abrading the riser 20 or the limbs 16 and 18. The sheath 43 also provides a low friction path along which the wire 42 can slide when the cam latches 32 and 34 are engaged or disengaged by the latch trigger 36.

Alternatively, the mechanical linkage can be other structures such as one or more actuating rods linked by levers and other structures known in the mechanical arts. An advantageous linkage is a well-known "Bowden cable" such as used on bicycle shifters. A Bowden cable has an actuating central wire that is slidable in a tubular sleeve and can be pulled in tension and moved in one direction within its sleeve. The mechanical linkage is preferably assisted by a return spring that pulls the flexible wire 42 and the device to which it is linked in the reverse direction. Of course it is not necessary that the interior wire be made of metal but metal is preferred because it has a high elastic modulus.

The wire of a mechanical linkage is typically connected to an actuated or actuating structure in a manner that permits some angle of rotation between the wire and the structure. This hinging action can be accomplished, for example, by a connector fixed to the wire and pivotally connected to the structure or by the wire extending through a hole in the structure and pivoting within that hole. The connections of the mechanical linkage to the cam latches and to the latch trigger are preferably, but not necessarily, made in a manner that permits such rotation.

Cam Latches. The detailed structural features of the preferred cam latches are illustrated in FIGS. 2 through 8. Only one cam latch is described because they are identical. Referring to FIGS. 2 through 8, the cam 24 is rotatably mounted to a cam bracket 41 and thereby to the end of the limb 16 and is rotatable around its eccentrically positioned cam axle 28. The cam bracket 41 has two parallel, spaced apart, bracket arms 45 that are connected together at their base by a web 47. The web 47 is fixed to the limb 16. The cam 24 is provided with a protrusion that is formed by a lateral pin 44, such as a roll pin, that is fixed to and transversely extends from the cam 24. Preferably the pin 44 extends transversely entirely through the cam 24 and protrudes laterally from both sides of the cam 24. When the cam 24 rotates, the pin 44 follows a circular path around the cam axle 28.

Figure 6:
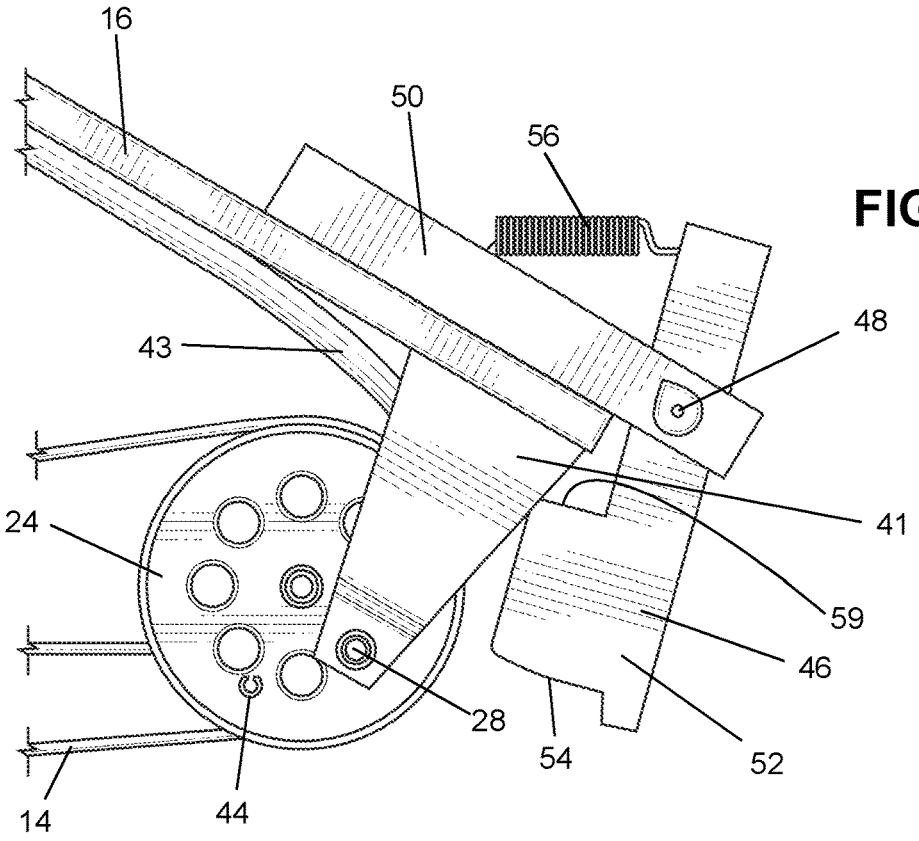
FIG. 6 is a left side view of the cam latch of FIG. 2 with the cam latch in its unlatched state.

The cam latch 32 also has a movable gate 46 that is connected to the wire 42 of the mechanical linkage 40. The preferred gate 46 is a U-shaped lever that is pivotable about its fulcrum axle 48. The fulcrum axle 48 is fixed in relation to the bow limb 16 by extending through aligned holes through opposite sides of a channel-shaped support bracket 50 that is fixed to the bow limb 16. The U-shaped lever of the pivotable gate 46 has two spaced apart arms 52. By pivoting the gate 46 about its fulcrum axle 48, the arms 52 can be moved into and out of the circular path that the pin 44 follows when the cam 24 rotates about its fulcrum axle 48. FIG. 6 shows the gate 46 pivoted out from the circular path that the pin 44 follows when the cam 24 rotates about its fulcrum axle 48.

Figure 7:
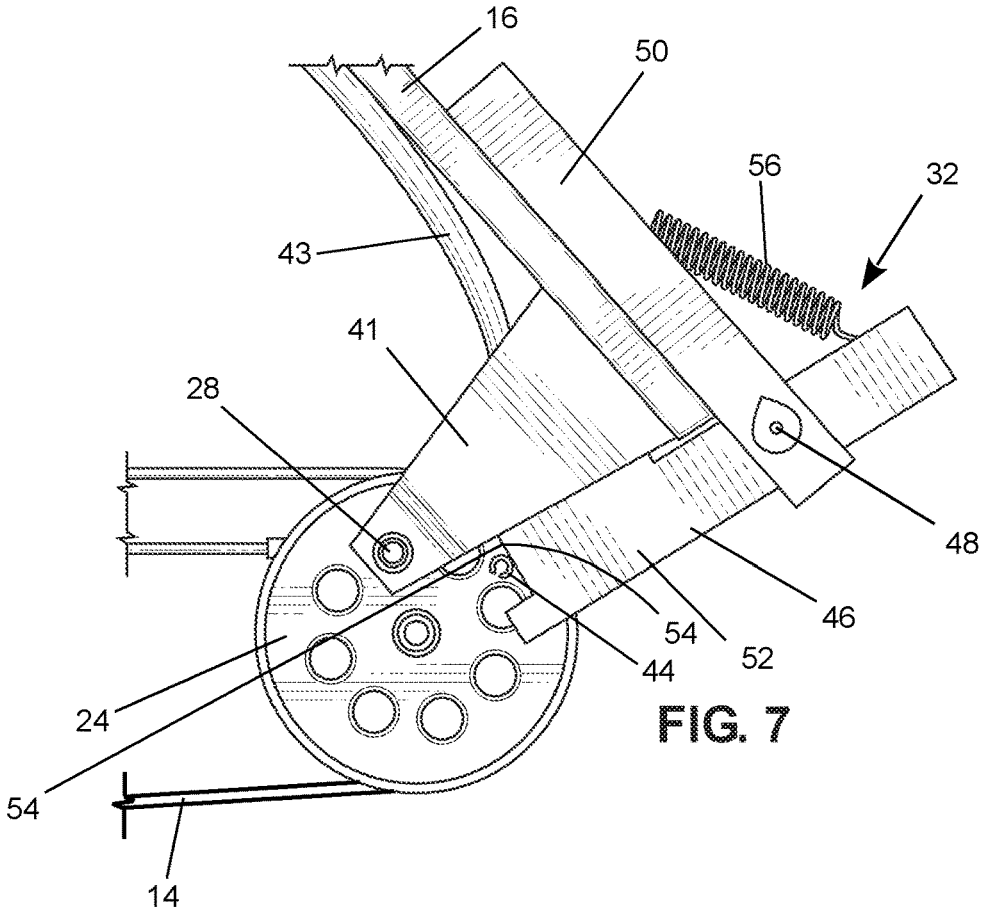
FIG. 7 is a left side view of the cam latch of FIG. 2 with the cam latch in its latched state.
Figure 8:
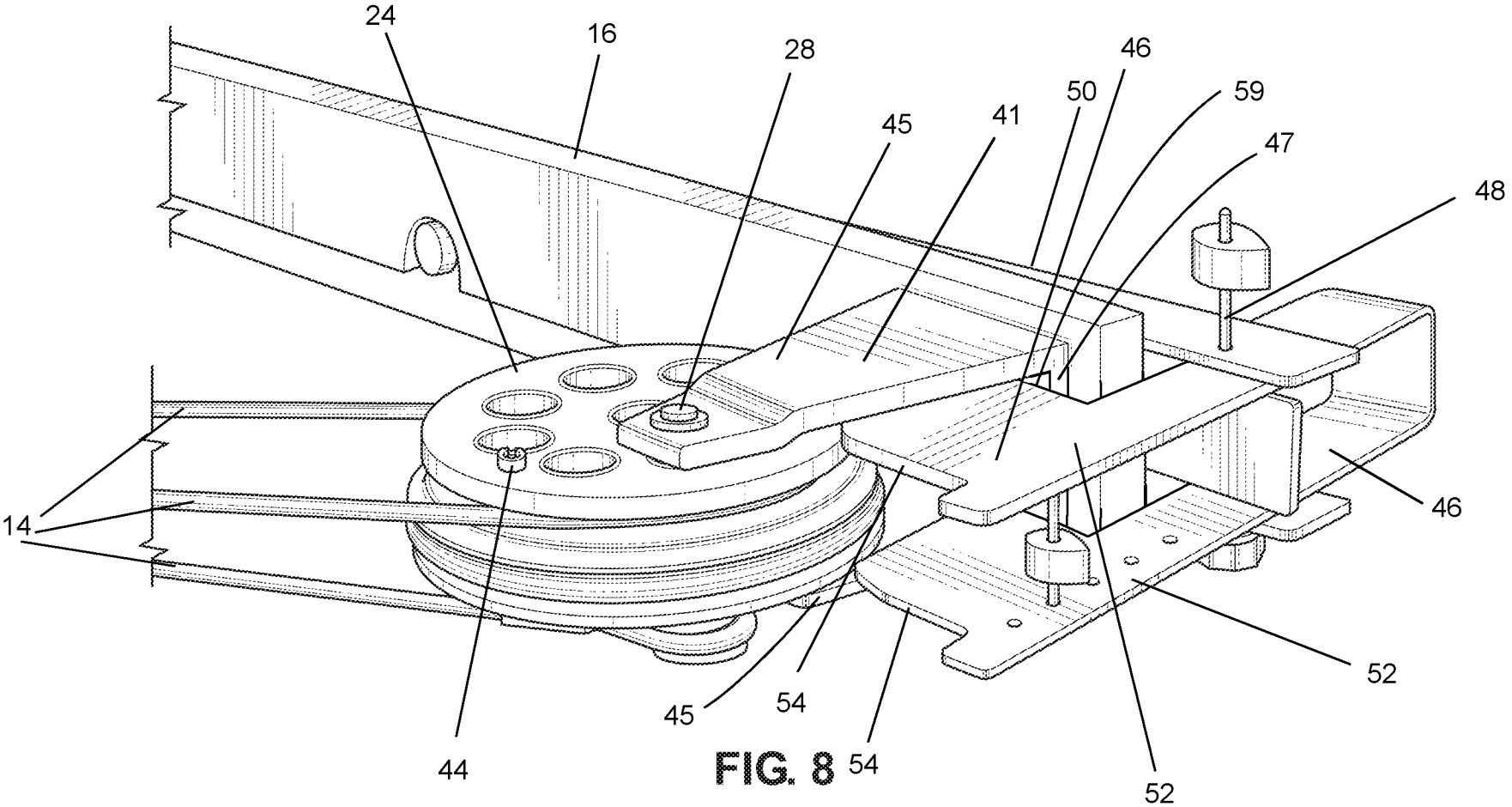
FIG. 8 is a view in perspective of the cam latch of FIG. 2 in its unlatched state.

If the archer pulls the drawstring 14 to full draw thereby causing the cams 26 and 28 to rotate in a first direction, a part of each of the arms 52, such as a shoulder 54 (FIGS. 4-6), can be pivoted into the circular path of the pin 44. FIG. 7 illustrates the cam latch 32 in that state. With the shoulder 54 positioned in the circular path of the pin 44, the archer gradually releases the bowstring, preferably slowly and gently, allowing the cams to rotate in the opposite direction until the pin 44 seats in contacting engagement against the shoulder 54. The shoulder 54 then prevents further rotation of the cams 24 and 26 as illustrated in FIG. 7.

The archer actuates the cam latches 32 and 34 in the above manner by pulling the trigger handle 38 of the latch trigger 36 back toward the hand grip 22. The action of the latch trigger 36 will be seen in more detail in the subsequent description of it. Essentially, actuation of the latch trigger 36 pulls on the flexible wire 42 of the mechanical linkage 40 and thereby pulls and pivots the arms 52 of the gate 46, along with their shoulders 54 (and simultaneously the corresponding components on the other cam latch), into the path of the pin 44.

In order to stop the pivotal motion of the arms 52 when the shoulder 54 has moved into the circular path of the pin 44, the arms 52 also have a stop shoulder 59. The stop shoulder 59 is spaced away from the web 47 of the cam bracket 41 when the pivotal arms 52 have moved out away from the circular path of the pin 44. The stop shoulder 59 is configured and dimensioned so that it seats against the exposed inner surface of the web 47 when the arms 52 are pivoted to move the shoulder 54 into the circular path of the pin 44. That contact of the stop shoulder 59 against the web 47 prevents further rotation of the movable gate 46 and the resistance to further movement of the latch trigger 36 is felt by the archer. Of course a variety of other stop mechanisms can alternatively also be provided such as a boss or finger protruding inwardly from the interior surface of the arms 45 of the cam bracket 41.

The mechanical linkage 40 can be configured to permit its flexible wire 42 to also push and return the arms 52 of the gate 46 out of the circular path of the pin 44, for example by using a Bowden cable. Preferably, however, each gate 46 is provided with a return spring 56. The return spring 56 is fixed at one end to the movable gate 46 and is fixed at its opposite end with respect to a limb. More specifically, that opposite end of the spring 56 is attached to the support bracket 50. Each spring 56 applies a force to the movable gate 46 in a direction urging the gate 46 and its shoulders 54 out of the circular path of the protruding pin 44 to permit rotation of the cams 24 and 26 in accordance with their normal operation.

In order to release the cam latches 32 and 34 from engagement with the pin 44 and resume normal operation of the bow, the archer pulls the drawstring back a small amount that is sufficient to slightly rotate the cams 24 and 26 and back the pin 44 away from the shoulders 54 of the gate 46. The archer then releases the latch trigger 36 and allows the return springs 56 to pivot the arms 52 with their shoulders 54 out of the circular path of the pin 44.

There are many other alternative structures know in the mechanical arts that can be adapted and used as the cam latch for the invention. The field of latches and locks provide several examples of such alternative latches that can be adapted for use with the cam latches of the invention. The cams can be provided with various kinds of protrusions that can be engaged by various kinds of gates or pawls. A striker type of opening, a hole, a notch or an indentation can be formed on the cams to function as a catch and be engaged by a pivoting arm or a sliding rod in the nature of a deadbolt. Even a brake caliper could be used although not preferred.

Latch Trigger.

Figure 11:
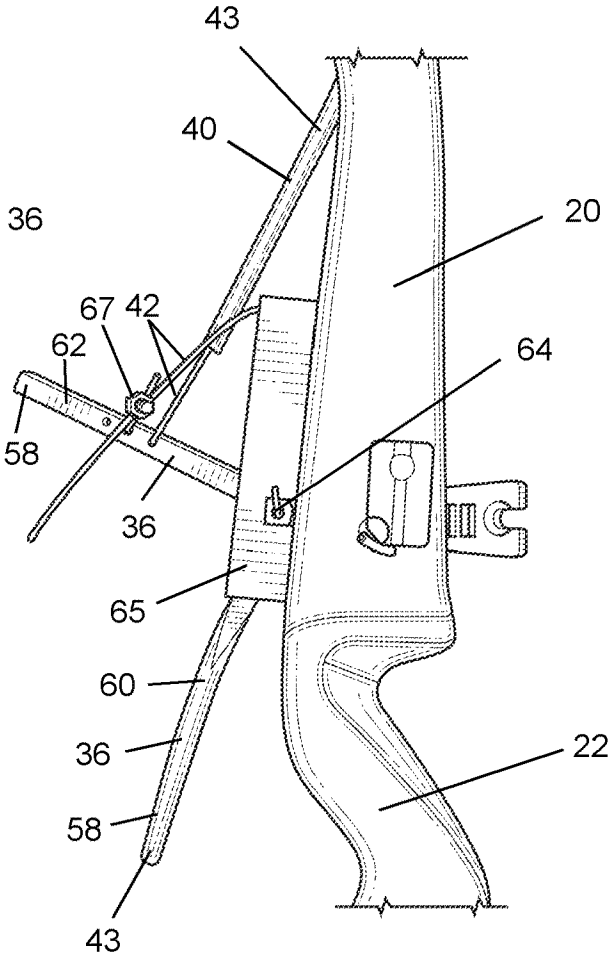
FIG. 11 is a left side, slightly enlarged, view of the latch trigger of FIG. 9.
Figure 10:
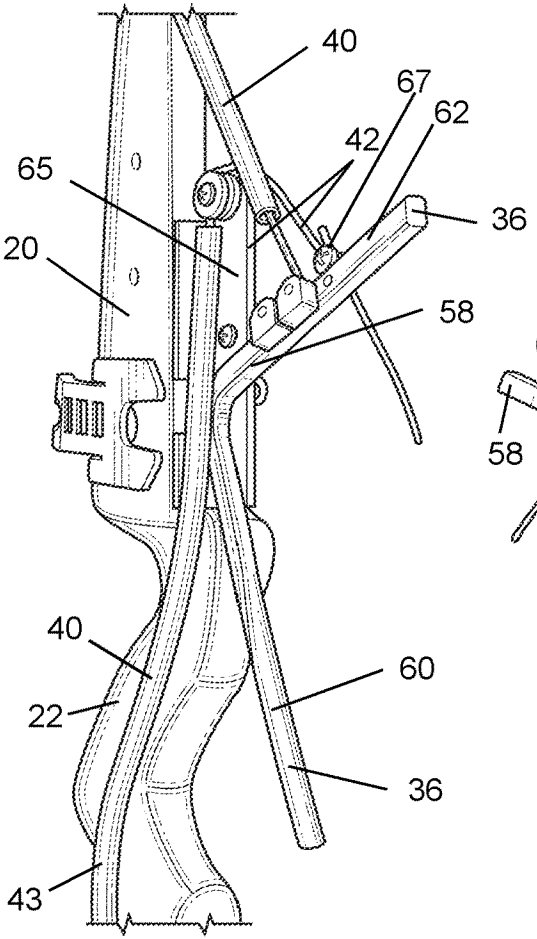
FIG. 10 is a view in perspective of the latch trigger of FIG. 9.
Figure 9:
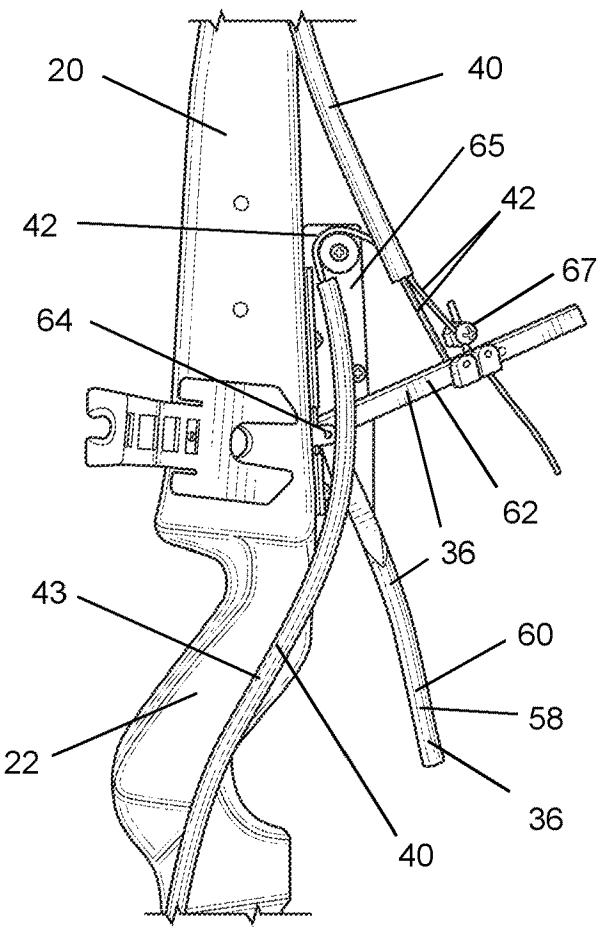
FIG. 9 is a right side view of the latch trigger of the invention.

Referring to FIGS. 9-11, the preferred latch trigger 36 is a bell crank 58 that is connected to the wire 42 of the mechanical linkage 40 and is configured to actuate the cam latches 32 and 34. The bell crank 58 has two lever arms 60 and 62 that are attached together and pivotally mounted to the riser 20 by a central bell crank axle 64. Pivotally mounting the bell crank 58 to the riser 20 is accomplished by using an interposed, U-shaped, mounting bracket 65 with the bell crank axle 64 extending though the two parallel legs of the mounting bracket 65. The mounting bracket is mounted directly to the riser 20. One of the lever arms 60 and 62 is the trigger handle 38 that extends forward of the hand grip 22. The trigger handle 38 is positioned within reach of the fingers of an archer when the archer's hand is positioned on the hand grip in a shooting configuration. This position allows an archer to comfortably extend his or her fingers forward and around the trigger handle 38 to pull the trigger handle 38 aft toward the hand grip 22.

The central flexible wire 42 is connected to the upper lever arm 62 of the bell crank 58. The central flexible wire 42 is preferably in two component segments, one leading to the upper cam latch 32 and the other leading to the lower cam latch 34. The upper segment of the flexible wire 42 leads directly to its connection to the upper cam latch 32. The lower segment of the flexible wire 42 leads around a sheave 66 (FIG. 9) and then directly to the lower cam latch 34. Pulling the trigger handle 38 back toward the hand grip 22 pivots the bell crank 58 and pulls on both segments of the central flexible wire 42 of the mechanical linkage 40. That motion of the trigger handle 38 and the central wire 42 moves the cam latches 32 and 34 into the position for engagement with a cam in order to block its rotation.

Referring to FIGS. 9-11, one of the two flexible wires 42 that connect the latch trigger 36 to the cam latches 32 and 34 is formed as two segments which are connected end to end and joined together by an adjustable wire clamp 67. The purpose of that arrangement is to allow the two trigger latches 32 and 34 to be synchronized so that both trigger latches 32 and 34 are moved simultaneously into their latching positions in the circular path of the pin 44. The adjustable wire clamp 67 allows the effective length of at least one of the flexible wires 42 to be adjusted so that the stop shoulders 59 simultaneously reach their stop position. Alternatively, the same arrangement can be also provided with a second wire clamp for the other flexible wire in order to make their adjustment easier.

Slack Tightener.

When the archer pulls the bowstring 14 to full draw, the aft-most segment of the bowstring 14 is bent into two segments oriented at an obtuse angle to each other. If, with the bowstring 14 at full draw, the archer actuates the cam latches 32 and 34 to prevent rotation of the cams 24 and 26 and then releases the bowstring 14 from his or her hand, the aft-most segment of the bowstring 14 between the cams 24 and 26 becomes slack. The reason is that the distal ends of the limbs 16 and 18, and therefore the cams 24 and 26, have moved closer together. This slack in the bowstring 14 can allow the bowstring 14 to move sideward and be misaligned with the peripheral outer grooves in the cams 24 and 26. If the misalignment is not corrected before the archer disengages the cam latches 32 and 34 from the cams 24 and 26, it is possible that the bowstring 14 could come out of the peripheral grooves and cause a malfunction of the compound bow when the archer releases the bowstring 14.

A slack tightener to avoid this potential problem is not absolutely necessary. An archer can, as soon as the cam latches are engaged to prevent rotation of the cams, continue to hold the drawn bowstring with a slight force that is sufficient to hold the slack portion of the bowstring tightly enough that the bowstring will not come away from the peripheral grooves around the cams. But the slack tightener is very much preferred because it avoids the need for the archer to concentrate on maintaining such a slight force on the bowstring and therefore avoids the consequences of failing to do so. The slack tightener allows the archer to instead concentrate on hunting.

Figure 12:
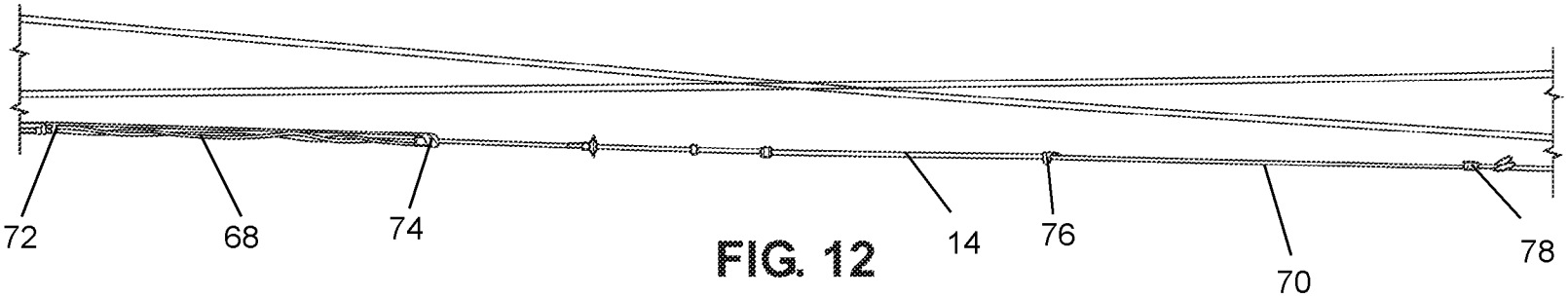
FIG. 12 is a side view of the aft-most segment of the bowstring while held in tension and having two slack tighteners of the invention mounted to the bowstring.
Figure 13:
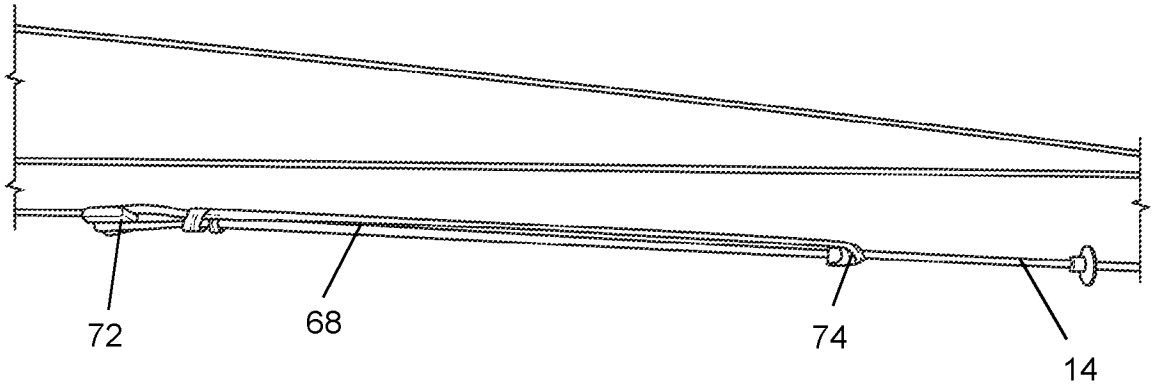
FIG. 13 is a side view like FIG. 12 but enlarged and showing only one slack tightener of the invention.
Figure 14:
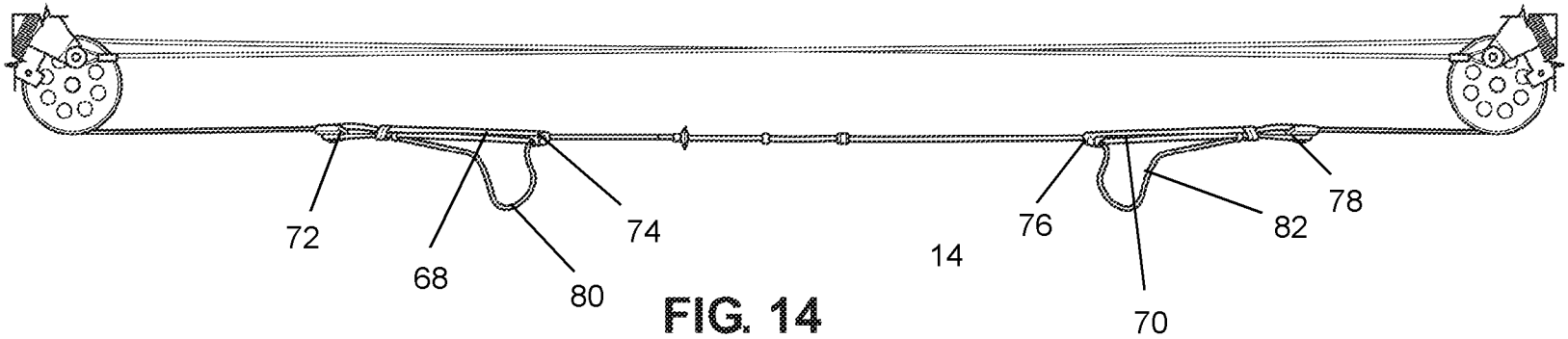
FIG. 14 is a side view like FIG. 12 except that the bow has been pulled to full draw and the cam latches have engaged the cams so that the bowstring is relaxed and its slack is formed into a pair of loops by the slack tighteners of the invention.

Referring to FIGS. 12-14, the slack tightener has at least one, and preferably two, elastically resilient bands 68 and 70. Although a single elastically resilient band could be used, preferably there are two slack tighteners each having its own elastically resilient band. The two slack tighteners are positioned entirely on opposite sides of a nocking point 71 on the aft-most segment of the bowstring 14.

Each elastically resilient band 68 and 70 has two spaced-apart band ends 72, 74, 76 and 78. Each of the spaced apart band ends 72, 74, 76 and 78 is fixed to a different one of two spaced apart locations on the aft-most segment of the bowstring 14. Consequently, the reference numbers for the band ends also indicate the spaced apart locations on the bowstring 14 to which the band ends are fixed. In order for the slack tightener to take up the slack, there is an important relationship between (1) the length of the elastically resilient band 68 between its ends when the band 68 is relaxed and (2) the distance between the spaced apart locations on the aft-most segment of the bowstring 14 when the bowstring is arranged in a straight line.

When the bowstring 14 is pulled straight (i.e. into a straight line between the cams 24 and 26) the two spaced apart locations on the aft-most segment of the bowstring 14 are spaced further apart than the two spaced-apart ends of each elastically resilient band when the band is in a relaxed state. In other words, if the elastically resilient bands 68 and 70 are fixed to the bowstring 14 in the manner described, and the aft-most segment of the bowstring 14 is pulled straight, the elastically resilient bands become stretched. The result is that the bands apply equal and opposite forces on the spaced apart locations on the bowstring in a direction tending to pull the spaced apart locations on the bowstring toward each other.

Figure 4:
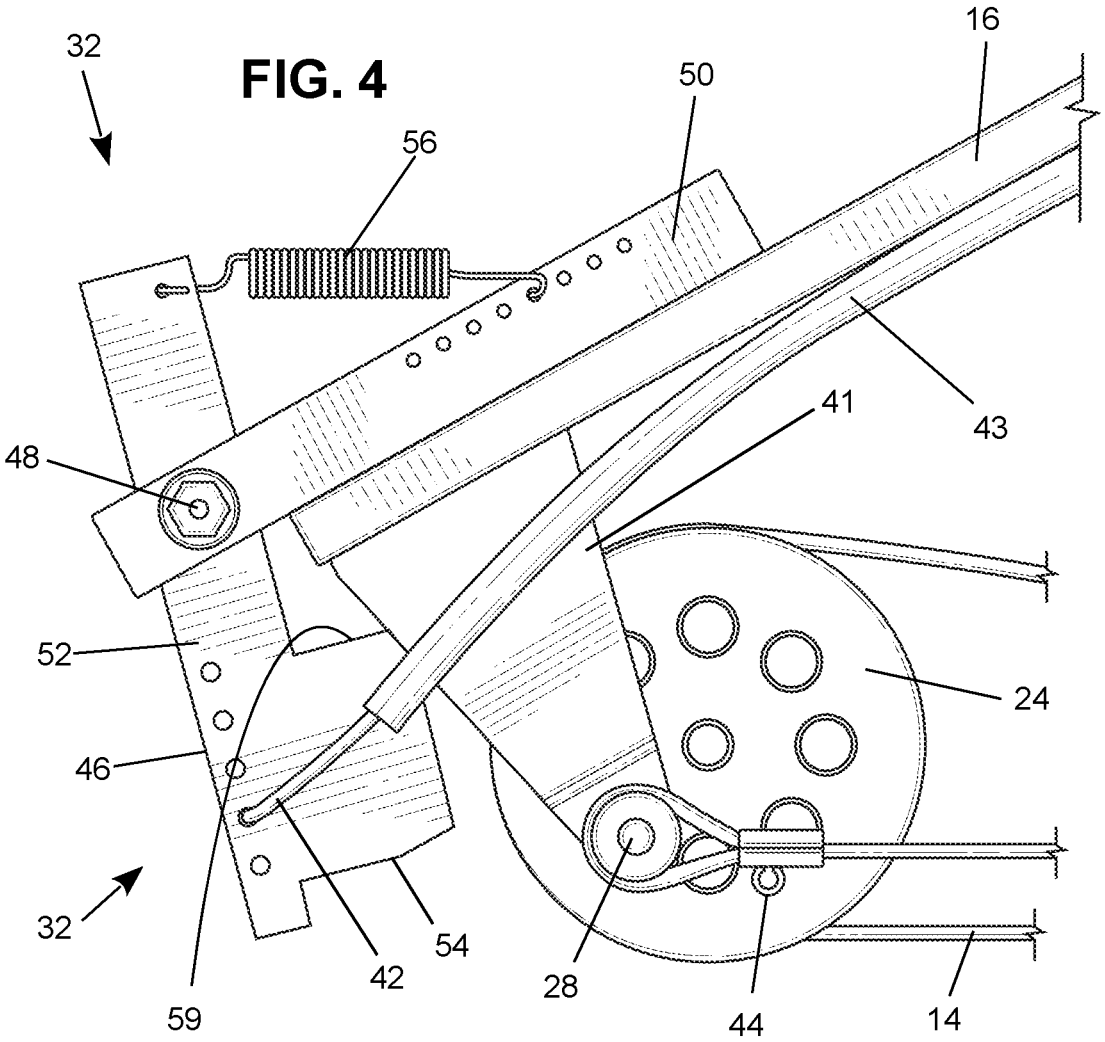
FIG. 4 is a right side view of the cam latch of FIG. 2.
Figure 5:
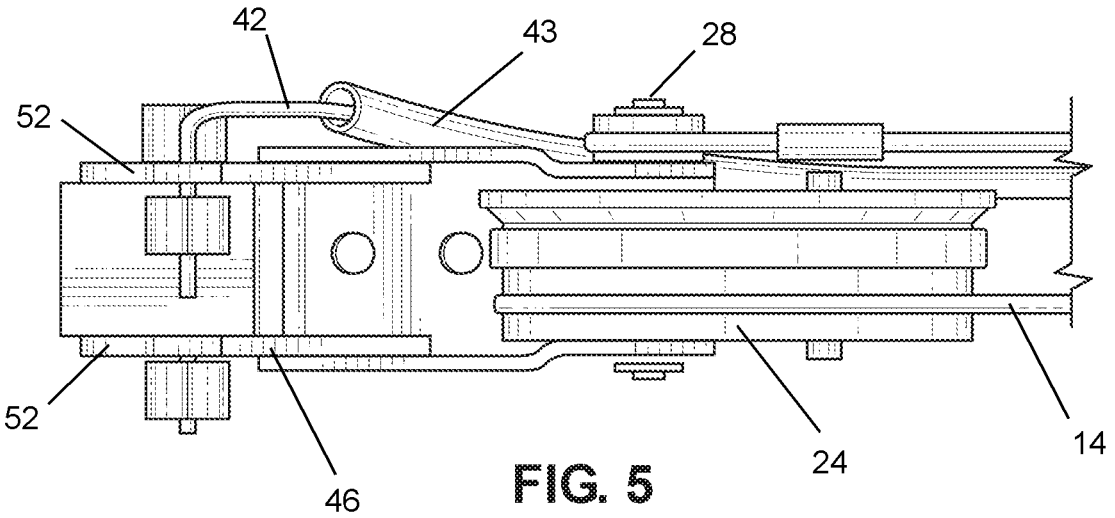
FIG. 5 is a bottom view of the cam latch of FIG. 2.

The distance between the ends of the elastically resilient bands 68 and 70 and the distance between the two spaced apart locations on the aft-most segment of the bowstring to which the band ends 72-78 are attached should be selected so that, after the bowstring is pulled back to full draw and the cams are latched against rotation, the elastically resilient bands 68 and 70 will take up all the slack and pull the slack bowstring 14 into two loops 80 and 82 as illustrated in FIG. 14. The elastically resilient bands 68 and 70 should have a spring constant that enables them to hold the outermost ends of the bowstring within the peripheral grooves around the cams. In other words, the distance between the spaced apart locations on the aft-most segment of the bowstring and the length of the elastically resilient band between the two spaced apart band ends are configured to pull into a loop the segment of the bowstring that is between the spaced apart locations on the aft-most segment of the bowstring and maintain tension on the bowstring after the bowstring has been pulled to full draw and the cam latches are engaged with the cams. This condition is satisfied when the elastically resilient bands 68 and 70 and the segments of the bowstring 14 adjacent those bands are aligned along a straight line as illustrated in FIG. 4.

There are many structures and materials that can be used for the elastically resilient bands. Commercially available rubber bands of the type that are commonly used in offices were used to construct an embodiment of the invention. An elastically resilient band is a cord or line of any cross sectional configuration that, when two spaced apart locations on the band are pulled away from each other, the band exerts opposite forces in a direction tending to pull the spaced apart locations, and a flexible structure that is attached to those locations, back toward each other. As used with the invention an elastically resilient band could be a metal or plastic spring although that is not preferred because of the abrasion of the bowstring that would likely cause.

It should be apparent that embodiments of the invention can be used with various kinds of compound bows, including long bows, and can be used on bows in combination with other devices and mechanisms that are also used on the bows.

REFERENCE NUMBER TABLE archer 10
compound bow 12
bowstring 14
limbs 16 (upper) and 18 (lower)
riser 20
hand grip 22
upper cam 24
lower cam 26
upper cam axle 28
lower cam axle 30
upper cam latch 32
lower cam latch 34
latch trigger 36
trigger handle 38 of latch trigger
mechanical linkage 40
cam bracket 41
flexible wire 42
protective sheath 43 around flexible wire
pin 44 protruding laterally from cam
arms 45 of cam bracket
movable gate 46 of the cam latch
web 47 of cam bracket
gate lever fulcrum axle 48
stop shoulder 49 of movable gate arms
support bracket 50 for lever fulcrum axle
arms 52 of movable gate
shoulder 54 of gate arms
return spring 56
bell crank 58 of latch trigger
stop shoulder 59 of movable gate
lever arms 60 and 62 of latch trigger
bell crank axle 64
mounting bracket 65 for bell crank latch trigger
sheave 66
adjustable wire clamp 67
elastically resilient bands 68 and 70 of slack tightener
nocking point 71
ends 72, 74, 76 and 78 of elastically resilient bands
bowstring slack loops 80 and 82

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A compound archery bow having a bowstring with an aft-most segment and a pair of limbs connected to and extending in opposite directions from opposite ends of an interposed riser, the riser having a central hand grip, the bow also including at least two rotatable cams, said cams being rotatably mounted to a cam axle at distally opposite ends of each limb and peripherally engaging the bowstring, the archery bow further comprising:

(a) at least two cam latches, said cam latches being mounted at a distally opposite end of each limb, each cam latch being movable into engagement with a cam to latch and prevent rotation of the cams and each cam latch comprising:
  (i) a pin fixed to and transversely extending outwardly from the cam and moving in a circular path around the axle of the cam during rotation of the cam; and
  (ii) a lever forming a movable gate and connected to a mechanical linkage, the movable gate being rotatable by the mechanical linkage into the circular path of the pin to engage the pin and prevent rotation of the cam and being movable out of the circular path to permit rotation of the cam, the movable gate having a spring fixed at one end to the movable gate and fixed at its opposite end with respect to a riser, the spring applying a force to the movable gate in a direction urging the gate out of the circular path of the pin to permit rotation of the cam;

(b) a movable latch trigger mounted to the riser adjacent the hand grip;

(c) said mechanical linkage being connected between the latch trigger and each of the cam latches, the mechanical linkage being movable by movement of the latch trigger to move the cam latches into engagement with the pin of each of the cams and prevent rotation of the cams and also being movable by movement of the latch trigger to release the cam latches into disengagement with the cams and permit rotation of the cams; and (d) a slack tightener comprising
  an elastically resilient band that has two spaced apart band ends, each of the spaced apart band ends being fixed to a different one of two spaced apart locations on the aft-most segment of the bowstring, the two spaced apart locations on the aft-most segment of the bowstring, when the bowstring is pulled straight, being spaced further apart than the two spaced apart band ends when the band is in a relaxed state so that the band applies equal and opposite force on the spaced apart locations on the bowstring in a direction tending to pull the spaced apart locations on the bowstring toward each other.

2. A compound archery bow in accordance with claim 1 wherein the latch trigger comprises a lever handle pivotally mounted to the riser and extending forward of the hand grip, the lever handle and the mechanical linkage being configured to move the cam latch into engagement with a cam by pivoting movement of the lever handle toward the hand grip.

3. A compound archery bow in accordance with claim 1 wherein there are two of said slack tighteners, the two slack tighteners positioned entirely on opposite sides of a nocking point on the bowstring.

4. A compound archery bow in accordance with claim 3 wherein the distance between the spaced apart locations on the aft-most segment of the bowstring and the distance between the two spaced apart band ends are configured to pull into a loop a segment of the bowstring that is between spaced apart locations on the aft-most segment of the bowstring and maintain tension on the bowstring when the bowstring is pulled and the cam latches are engaged with the cams.

5. A compound archery bow in accordance with claim 4 wherein the latch trigger comprises a trigger handle pivotally mounted to the riser and extending forward of the hand grip, the trigger handle and the mechanical linkage being configured to move the cam latch into engagement with a cam by pivoting movement of the lever handle toward the hand grip.

6. A compound archery bow in accordance with claim 5 wherein the trigger comprises a bell crank connected to the mechanical linkage and configured to actuate the cam latches, the bell crank including two lever arms attached together and pivotally mounted to the riser, one of said lever arms being said trigger handle extending forward of the hand grip within reach of the fingers of an archer when an archer's hand is positioned on the hand grip in a shooting configuration.

7. A compound archery bow in accordance with claim 6 wherein the mechanical linkage comprises flexible wire connected to the trigger and extending from the latch trigger to each of the cam latches and applying a tensile force on the cam latches when the lever handle is pulled by the archer toward the hand grip, the tensile force moving the cam latches into position that prevents rotation of the cams.

8. A compound archery bow in accordance with claim 7 wherein the gate includes a shoulder that engages the pin when the gate is pivoted into the circular path of the pin and the archer releases the bowstring.

9. A compound archery bow in accordance with claim 8 wherein the wire of the mechanical linkage is a central wire of a Bowden cable.

* * * * *